US008590991B2

(12) United States Patent
Radusin

(10) Patent No.: US 8,590,991 B2
(45) Date of Patent: Nov. 26, 2013

(54) PULLOUT GUIDE FOR FURNITURE PULLOUT PARTS

(75) Inventor: Darko Radusin, Steinhagen (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 285 days.

(21) Appl. No.: 12/999,391

(22) PCT Filed: Jun. 10, 2009

(86) PCT No.: PCT/EP2009/057188

§ 371 (c)(1),
(2), (4) Date: Apr. 4, 2011

(87) PCT Pub. No.: WO2009/153207

PCT Pub. Date: Dec. 23, 2009

(65) Prior Publication Data

US 2011/0200278 A1 Aug. 18, 2011

Related U.S. Application Data

(60) Provisional application No. 61/073,924, filed on Jun. 19, 2008.

(30) Foreign Application Priority Data

Jun. 19, 2008 (DE) ..... 20 2008 008 121 U

(51) Int. Cl.
*A47B 95/00* (2006.01)

(52) U.S. Cl.
USPC ..... 312/333; 312/334.6

(58) Field of Classification Search
USPC ..... 312/334.1–334.9, 334.11–334.19, 312/334.21–334.29, 334.31–334.39, 312/334.41–334.47, 333
See application file for complete search history.

(56) References Cited

U.S. PATENT DOCUMENTS 4,147,393 A * 4/1979 Nelson et al. ..... 384/22
4,191,434 A * 3/1980 Powell et al. ..... 312/407
4,476,848 A * 10/1984 Protas ..... 126/19 M (Continued)

FOREIGN PATENT DOCUMENTS

DE 201 07 278 8/2001
EP 1 847 198 10/2007

OTHER PUBLICATIONS

International Standard : "Safety of Machinery—Lubricants With Incidental Prtoduct Contact—Hygiene Requirement" ISO 21469, Feb. 15, 2006 (IN ENGLISH).

(Continued)

*Primary Examiner* — Darnell Jayne
*Assistant Examiner* — Andres F Gallego
(74) *Attorney, Agent, or Firm* — Michael J. Striker

(57) ABSTRACT

Drawer guide (1) for furniture drawer parts, comprising a guide track (2) that can be attached to the body of a piece of furniture and a glide track (3) that can be connected to a furniture drawer part, wherein the guide track (2) comprises a profile having a plurality of tracks (2*b*) for rolling members preferably comprising balls, said profile having mirror-image symmetry in cross section about at least one axis, and that the guide track (2) is attached detachably in form-fitted and/or positive fitted fashion at the end at two supporting moldings (4, 5) at the body of a piece of furniture.

12 Claims, 12 Drawing Sheets

(56) References Cited

U.S. PATENT DOCUMENTS

| | | | | |
|---|---|---|---|---|
| 4,681,289 | A * | 7/1987 | Gronlund et al. | 248/224.8 |
| 5,310,255 | A * | 5/1994 | Ranallo | 312/334.5 |
| 5,417,489 | A * | 5/1995 | Compagnucci | 312/334.11 |
| 5,570,943 | A * | 11/1996 | Schroder et al. | 312/334.11 |
| 5,775,788 | A * | 7/1998 | Sasse et al. | 312/334.38 |
| 5,882,100 | A * | 3/1999 | Rock | 312/334.34 |
| 6,499,818 | B2 * | 12/2002 | Brustle | 312/319.1 |
| 6,846,053 | B2 * | 1/2005 | Salice | 312/334.14 |
| 6,913,334 | B2 | 7/2005 | Weichelt | |
| 2005/0174022 | A1 * | 8/2005 | Kuttalek | 312/410 |
| 2006/0049732 | A1 * | 3/2006 | Prentner et al. | 312/334.1 |
| 2006/0175946 | A1 * | 8/2006 | Le | 312/333 |
| 2008/0203873 | A1 * | 8/2008 | Lautenschlager | 312/334.5 |
| 2008/0276808 | A1 * | 11/2008 | Sus et al. | 99/373 |
| 2008/0314067 | A1 * | 12/2008 | Lee | 62/441 |
| 2011/0012492 | A1 * | 1/2011 | Radusin | 312/334.8 |
| 2011/0187253 | A1 * | 8/2011 | Jaehrling et al. | 312/334.1 |

OTHER PUBLICATIONS

USDA H-1 Code of Federal Regulations 21 CFR 178.3570, Revised As of April 1, 2010, Title 21 , vol. 3—Food and Drugs, Chapter I—Food and Drug Administration Department of Health and Human Services Subchapter B—Food for Human Consumption.

* cited by examiner

PULLOUT GUIDE FOR FURNITURE PULLOUT PARTS

The invention described and claimed hereinbelow is also described in German Patent Document DE 20 2008 008 121.1, filed on Jun. 19, 2008, and U.S. Provisional Application Ser. No. 61/073,924, filed in the US on Jun. 19, 2008. The German Patent Document and the US Provisional Application, the subject matters of which are incorporated herein by reference, provide the basis for a claim of priority of invention under 35 U.S.C. 119(a)-(d) and under 35 USC §120, respectively.

The present invention relates to a pullout guide for furniture pullout parts, comprising a guide rail, which is fixable on the body of a piece of furniture, and a slide rail, which is connectable to a furniture pullout part.

Pullout guides of the type according to the species are known in manifold embodiments.

The guide rail is typically fastened via screw flanges on a furniture body. The screw flanges are an integral component of the guide rail.

Designs have also already been proposed in which the screw flanges are produced as separate parts, but are finally nonetheless fixedly connected to the guide rail.

The use of such pullout guides is possible without problems in many usage cases. In contrast, the known pullout guides are less well suitable for special intended uses, for example, in refrigerators or the like in which the interior of the body comprises a plastic shell.

The present invention is based on the object of disclosing a particularly simple design of a pullout guide according to the species, which is easily installable without problems in all possible applications in the body of a piece of furniture.

This object is achieved according to the invention in that the guide rail comprises a profile, which is mirror-symmetric in cross-section around at least one axis, having multiple runways for rolling bodies, preferably comprising spheres, and the guide rail is removably fixed in a friction-locked and/or formfitting manner at the end on two load-bearing molded parts provided on the body of a piece of furniture.

The design according to the invention permits the use of extremely simply made guide rails and accordingly also a significant material savings and additionally allows fixing and installation of the pullout guide without problems in the interior of a body of a piece of furniture in all conceivable applications. Only two load-bearing molded parts are required for this purpose, in which the guide rail is fixable in a friction-locked and/or formfitting manner. Large and complex screw connections are therefore not required.

Since the guide rails do not have screw flanges for fixing on the body of a piece of furniture, the pullout guides according to the invention may be used without restrictions on the left side and also on the right side, i.e., only a single type of guide rails is required for the left and right side walls of a piece of furniture.

If the pullout guides do not have to fulfill further auxiliary functions, the pullout guides according to the invention can also fulfill the desire for two-sided pullout capabilities without problems.

According to a preferred exemplary embodiment of the invention, the guide rail comprises a profile which is mirror-symmetric in cross-section around two axes running perpendicular to one another.

Such a profile is a known profile which has been used for some time in the field, and which has been employed up to this point as a pullout-extending middle rail. The advantage thus results in manufacturing, in particular for reasons of cost, that a new and additional profile does not have to be developed, but rather profiles which are typical and widespread in the field can be used.

Since typically pullout guides only require a one-sided pullout capability for a furniture pullout part, according to a preferred exemplary embodiment, the guide rail is fixed in a formfitting manner to the molded part at the rear in relation to the insertion direction and is fixed in the forward molded part in a friction-locked manner.

The formfitting fixing of the guide rail in the rear molded part offers the advantage that the pullout guide cannot be tilted upward in the pulled-out state and under vertical load.

The friction-locked fixing of the guide rail in the forward molded part is preferably performed via a spring element which is otherwise integrally produced with the molded part, and which loads the guide rail both in its longitudinal direction and also diagonally to the longitudinal direction. Therefore, fixing of the guide rail in the longitudinal direction without play is ensured and also unintentional detachment of the guide rail from its installation position is prevented.

The guide rail is equipped in its frontal end areas with notches which are preferably made symmetrically to one another, and which allow both the formfitting fixing of the guide rail on the rear molded part and also the springy fixing of the guide rail on the forward molded part.

The guide rail can thus be installed without consideration of specific installation positions, which substantially simplifies the manufacturing.

According to a further exemplary embodiment, it is provided that the pullout guide is equipped in a way known per se with a self-retractor, which is controlled via an actuator mounted on the slide rail.

A preferred embodiment provides that the self-retractor is fixed in a locked manner on the front molded part and the actuator is integrally molded with a plug which closes the forward front end of the slide rail.

In this way it is no longer necessary to weld the actuator onto the slide rail, which would be difficult in the case of planned uses of the pullout guide for refrigerators and freezers, for example, since these pullout guides require an elevated zinc coating to improve the corrosion protection.

If these high requirements for the corrosion resistance are not provided, of course, the actuator for the self-retractor can also be welded onto the slide rail in a typical manner.

If the pullout guide is used for refrigerators or the like, it is provided that the lubricating grease required for the rolling bodies is permissible for food and is suitable for the ultralow temperature range.

In the embodiment variants described up to this point, it has been assumed that the pullout guide or its guide rail and its slide rail are produced from metal.

Of course, for applications having lower loads to be expected, pullout guides according to the invention can also be manufactured completely from plastic and thus lubrication can be dispensed with.

The molded parts can be produced as separate components and screwed in place on the body of a piece of furniture. The possibility also exists of fixing the molded parts in a formfitting and/or friction-locked manner in recesses of a body provided for this purpose.

Finally, it is also possible to integrally produce the molded parts from plastic with an inner insert of a furniture body, as is typical in refrigerators, for example.

If needed, the molded parts may also be produced from ceramic, so that pullout guides according to the invention can also be employed for use in ovens having pyrolysis systems.

Overall, pullout guides according to the invention are therefore also particularly advantageous because substantially less material outlay is required by dispensing with the installation angle, this plays a large role in particular in the case of pullout guides produced from metals and in the event of use in refrigerators, since a substantially smaller component of metal parts must be cooled down to the desired interior temperature of a refrigerator in relation to typical pullout guide. This results in substantial energy savings.

Exemplary embodiments of the invention are shown in the appended drawings and are described in greater detail hereafter.

Figure 1:
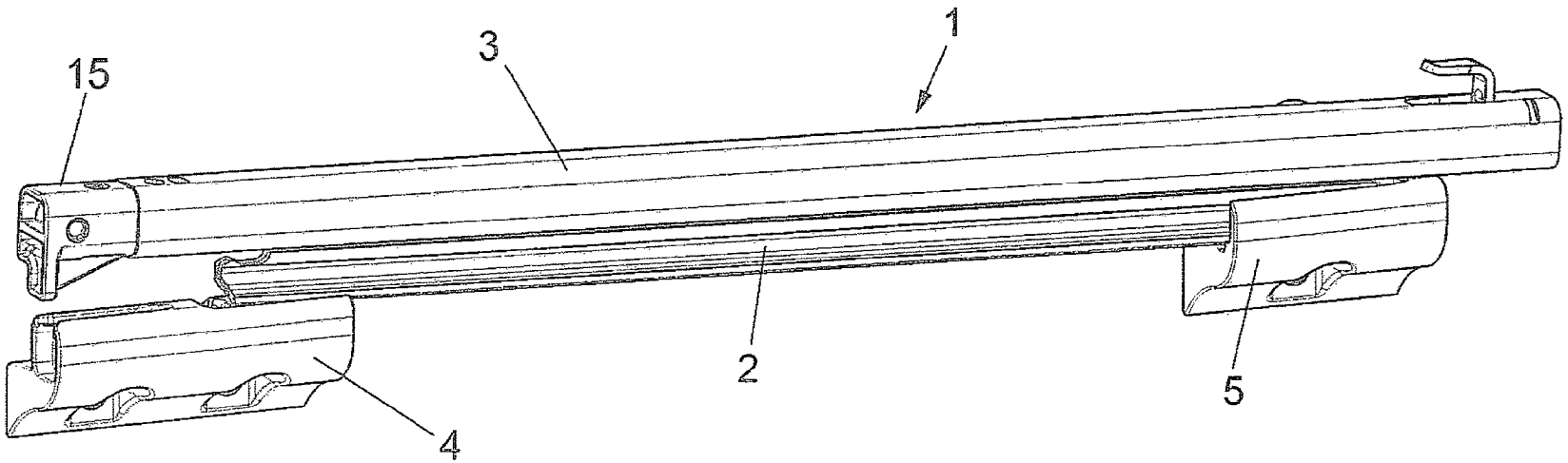
FIG. 1 shows a perspective view of a pullout guide according to the invention in a pre-installation position
Figure 2:
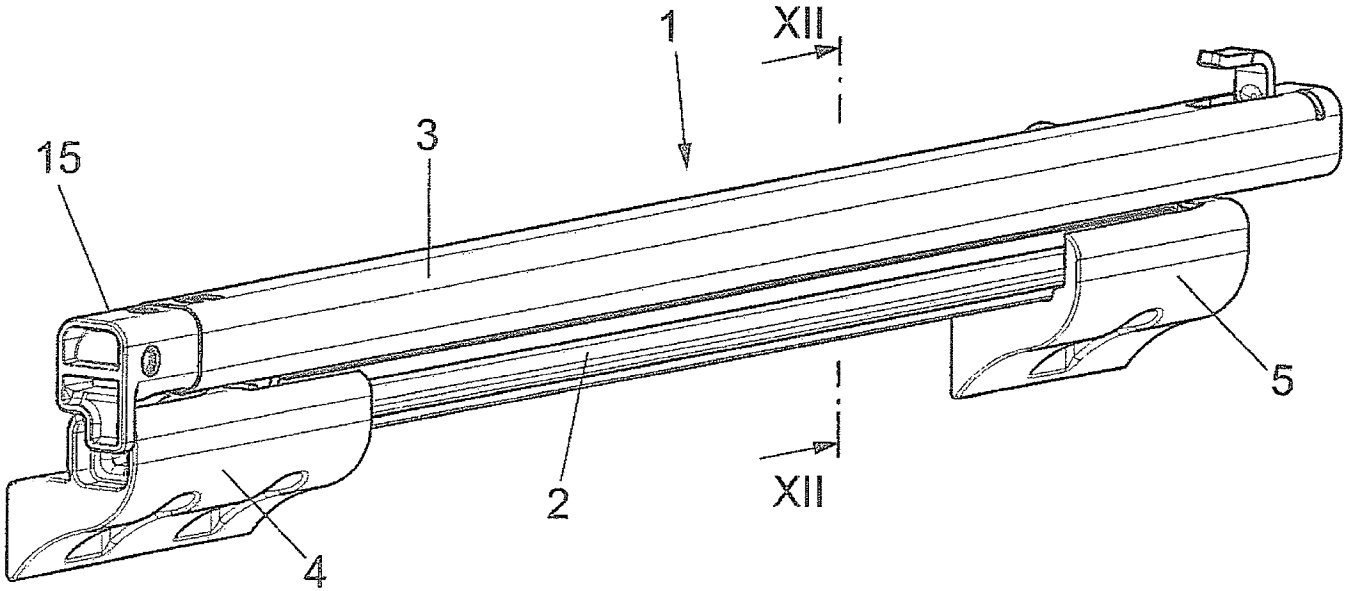
FIG. 2 shows a perspective view, corresponding to FIG. 1, of the pullout guide in the final installed state
Figure 3:
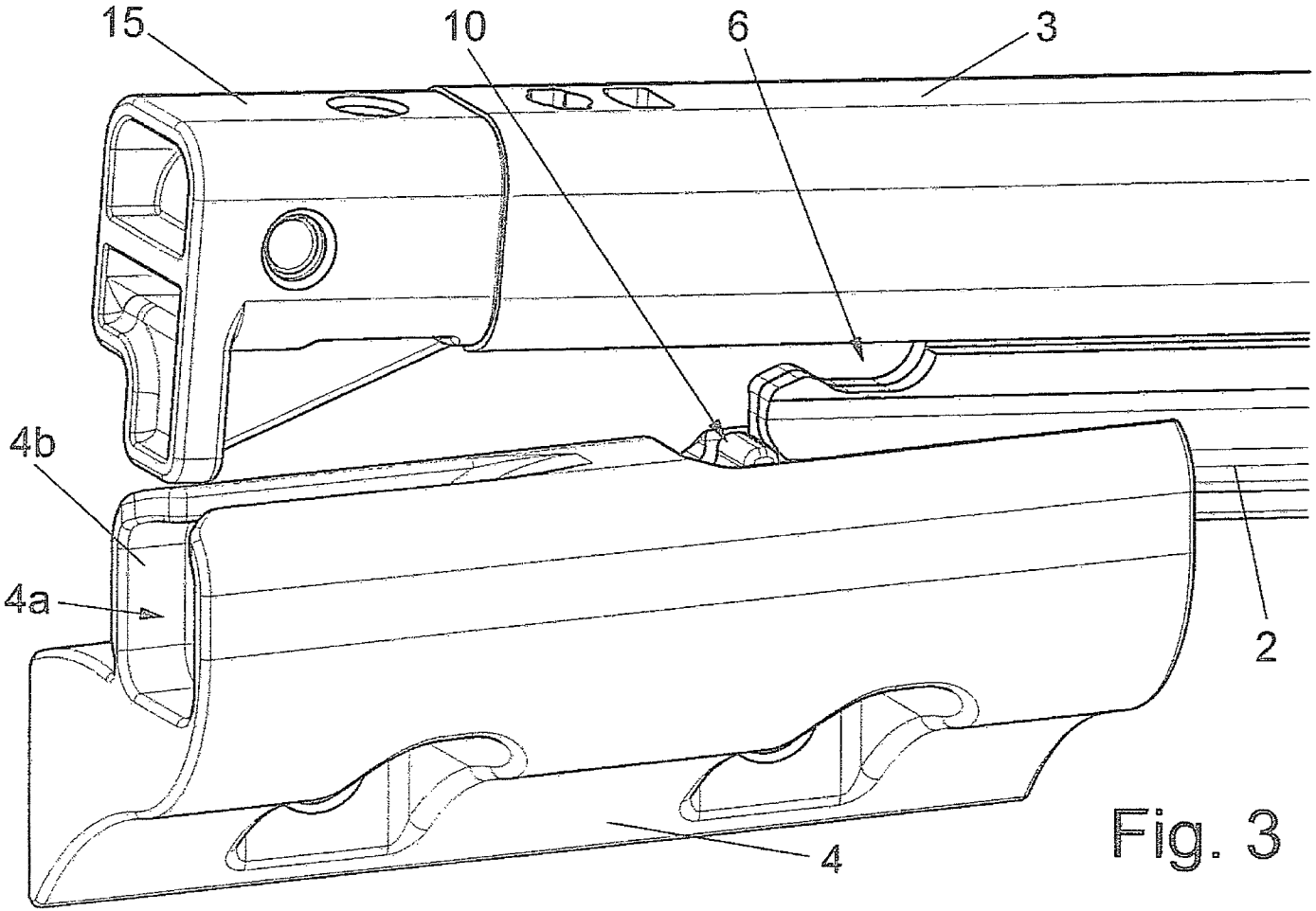
FIG. 3 shows an enlarged view of the forward end area of the pullout guide in the pre-installation position according to FIG. 1
Figure 4:
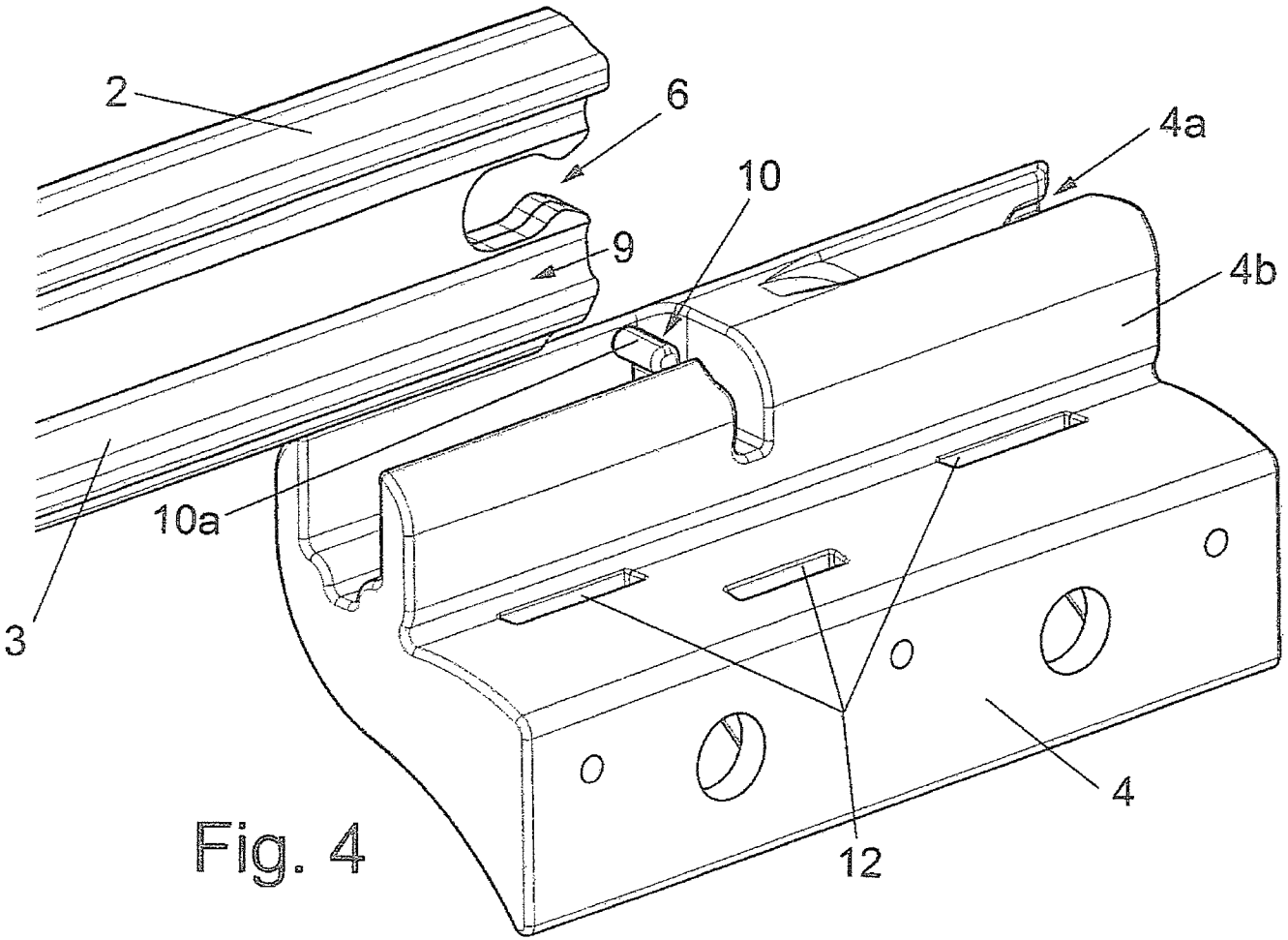
FIG. 4 shows a detail view corresponding to FIG. 3 from a viewing direction opposite to FIG. 3
Figure 5:
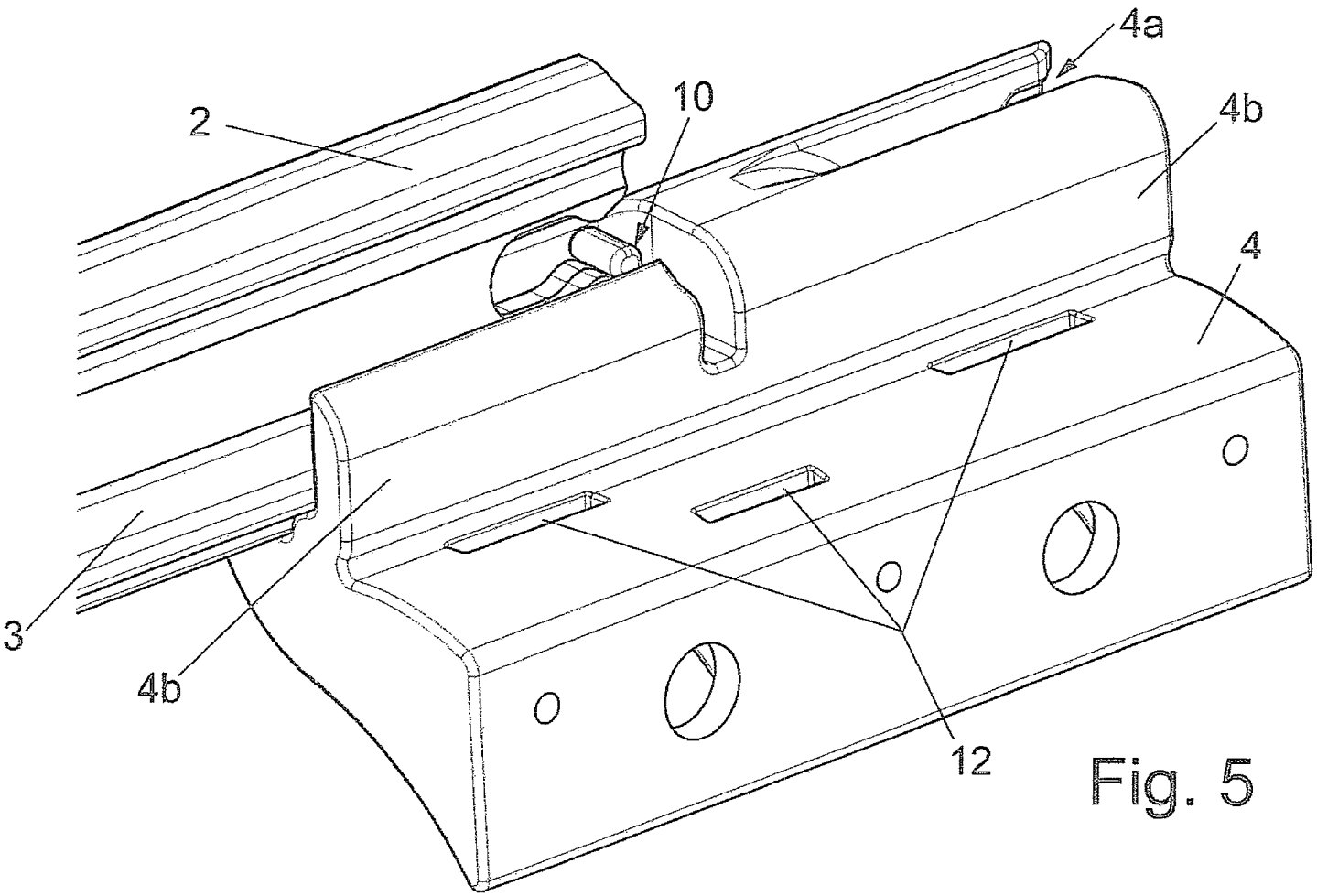
FIG. 5 shows a detail view corresponding to FIG. 4 with the final installed pullout guide

In each of FIGS. 1 and 2, a pullout guide is referred to in its entirety by the reference numeral 1, which essentially comprises a guide rail 2 and a slide rail 3, which is longitudinally displaceable in relation to the guide rail 2, and is fixable via two load-bearing molded parts 4 and 5 on the body of a piece of furniture (not shown).

The guide rail 2 is preferably a profile, which is mirror-symmetric in cross-section around two intersecting axes, having multiple runways for rolling bodies preferably comprising spheres, as are typically known as so-called middle rails for Quadro pullout guides.

The slide rail 3 is guided so it is longitudinally displaceable in relation to the guide rail 2 in a way known per se, which is therefore not shown in greater detail, via corresponding rolling bodies, preferably via spheres which are situated in a cage.

The guide rail 2 is fixed in a friction-locked and/or formfitting manner via the mentioned molded parts 4 and 5, which may be screwed in place on the inner wall of a furniture body, for example.

The guide rail 2 is fixed on the rear molded part 5, viewed in the insertion direction of the slide rail 3, in a formfitting manner, and is fixed on the forward molded part 4, in contrast, in a friction-locked and formfitting manner.

Figure 10:
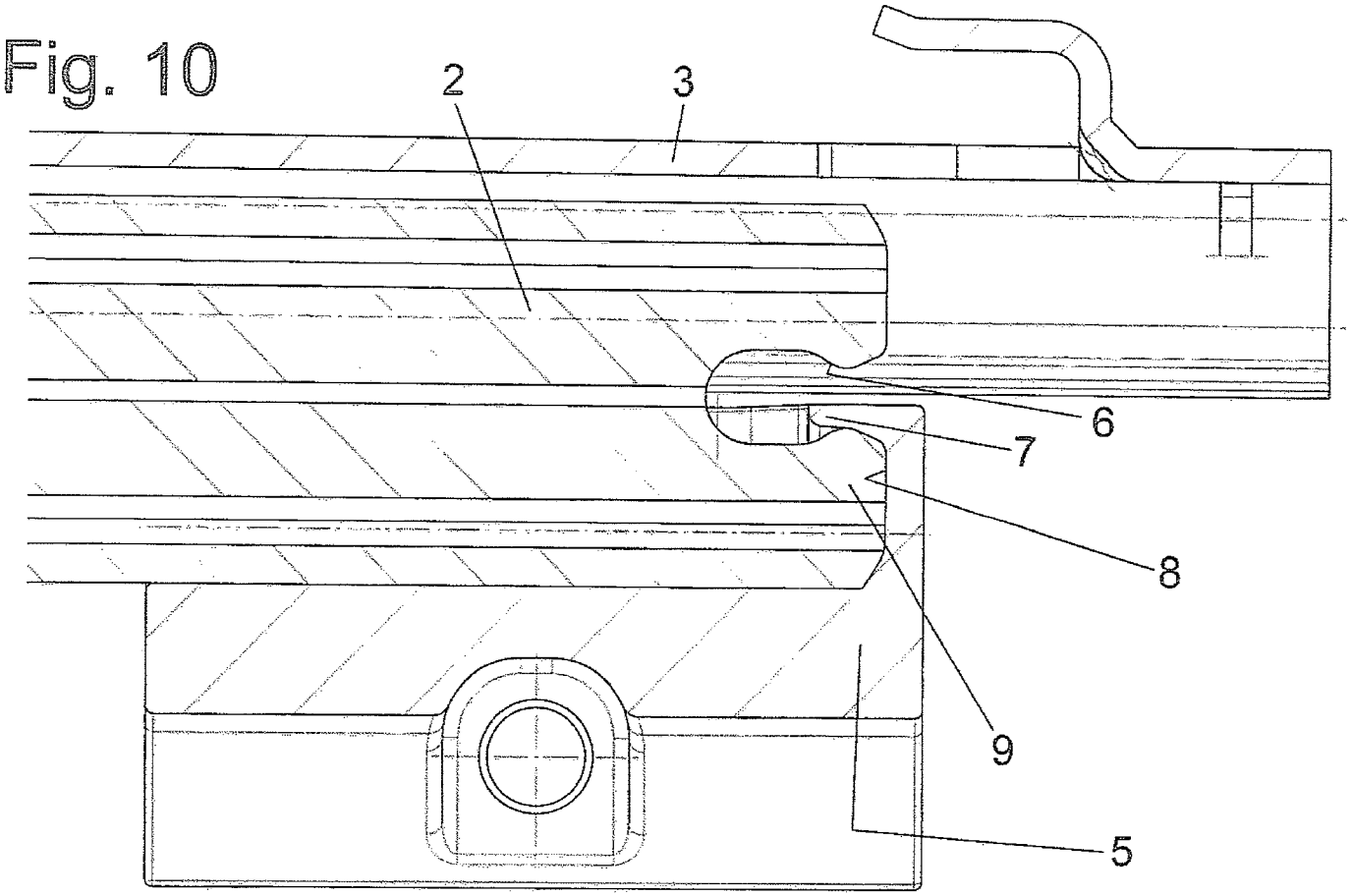
FIG. 10 shows a vertical section through the rear fastening area of a pullout guide according to the invention

FIG. 10 shows the fastening situation in the area of the rear molded part 5. It is clear that the guide rail 2 has a notch 6 on its rear frontal end, which is in the middle of the guide rail 2. A projection 7 of an undercut 8 of the molded part 5 protrudes into this notch 6. An area 9 of the guide rail 2 below the notch 6 protrudes into the undercut 8, so that the guide rail 2 cannot be lifted out upward in the installed state, as shown in FIG. 10.

Figure 11:
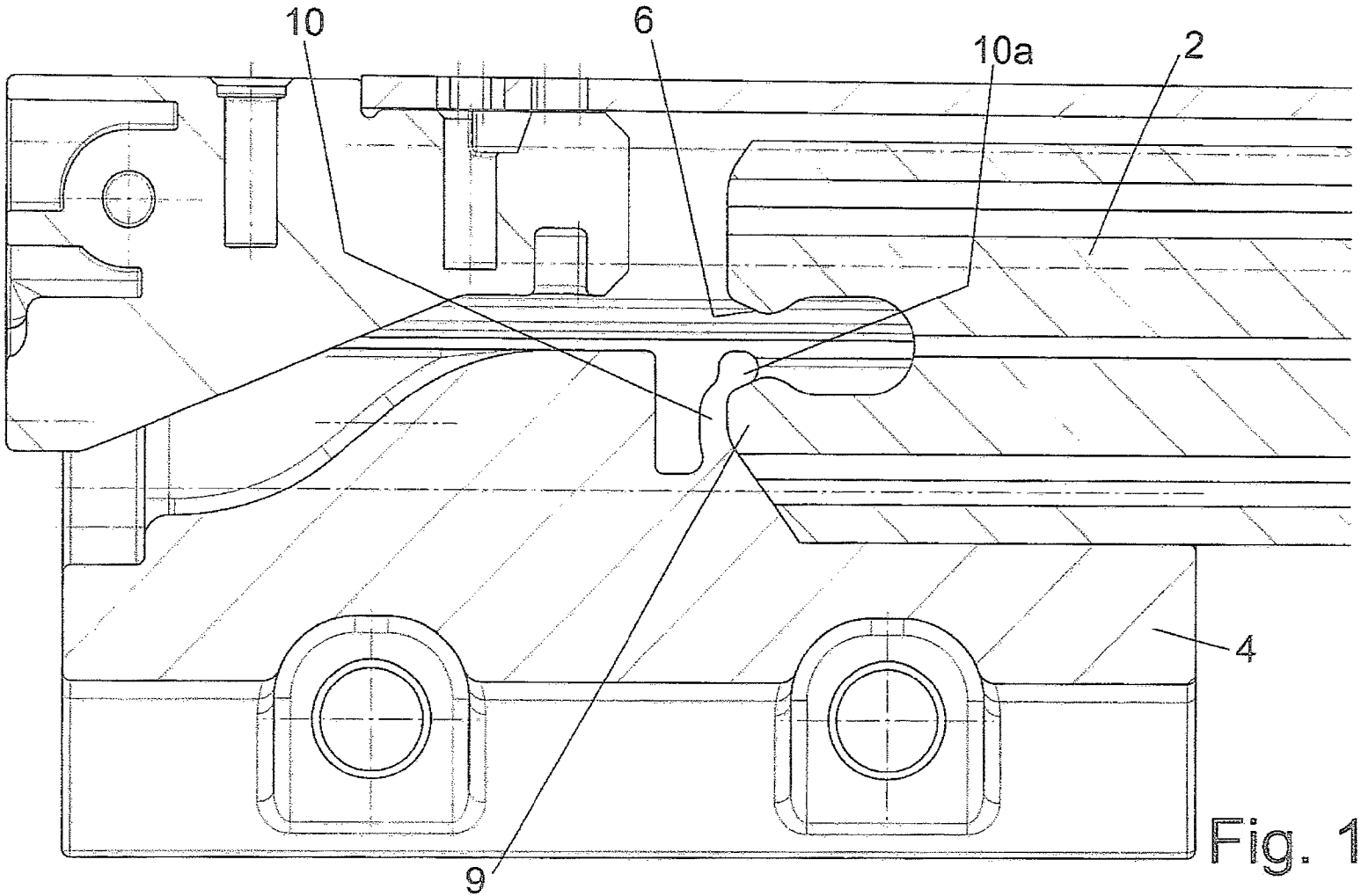
FIG. 11 shows a vertical section through the forward fastening area of a pullout guide according to the invention

It is clear from FIG. 11 that the guide rail 2 is also equipped in its forward end area with a notch 6, which is identical to the notch 6 in the rear end area of the guide rail 2. The guide rail 2 can thus be installed in arbitrary positions to begin with.

Furthermore, FIG. 11 shows that a spring element 10, which is integrally molded on the forward molded part 4, engages behind the section 9 of the guide rail 2 below the notch 6. This spring element 10 fixes the guide rail 2 both in the axial or insertion or pullout direction and additionally, through a projection 10*a*, also diagonally in relation to the displacement direction, so that undesired lifting out of the guide rail 2 is also prevented in the forward area of the holder.

FIGS. 1 and 2 show that for the purposes of installation, the slide rail 3 is first inserted in the longitudinal direction into the rear molded part 5 until the location according to FIG. 10 is achieved at least with respect to the axial position. The pullout guide 1 is then pressed downward out of the position shown in FIG. 1, i.e., in the direction of the forward molded part 4, until the final installation position according to FIG. 11 is reached.

The spring element 10 also permits the removal of the pullout guide 1, of course, since the hold-down action of the projection 10*a* can be overcome with intentional force application.

Securing of the guide rail 2 which is free of axial play in the two molded parts 4 and 5 is achieved by the spring element 10. In addition, a certain tolerance compensation also results through this spring-loaded fixing.

Figure 6:
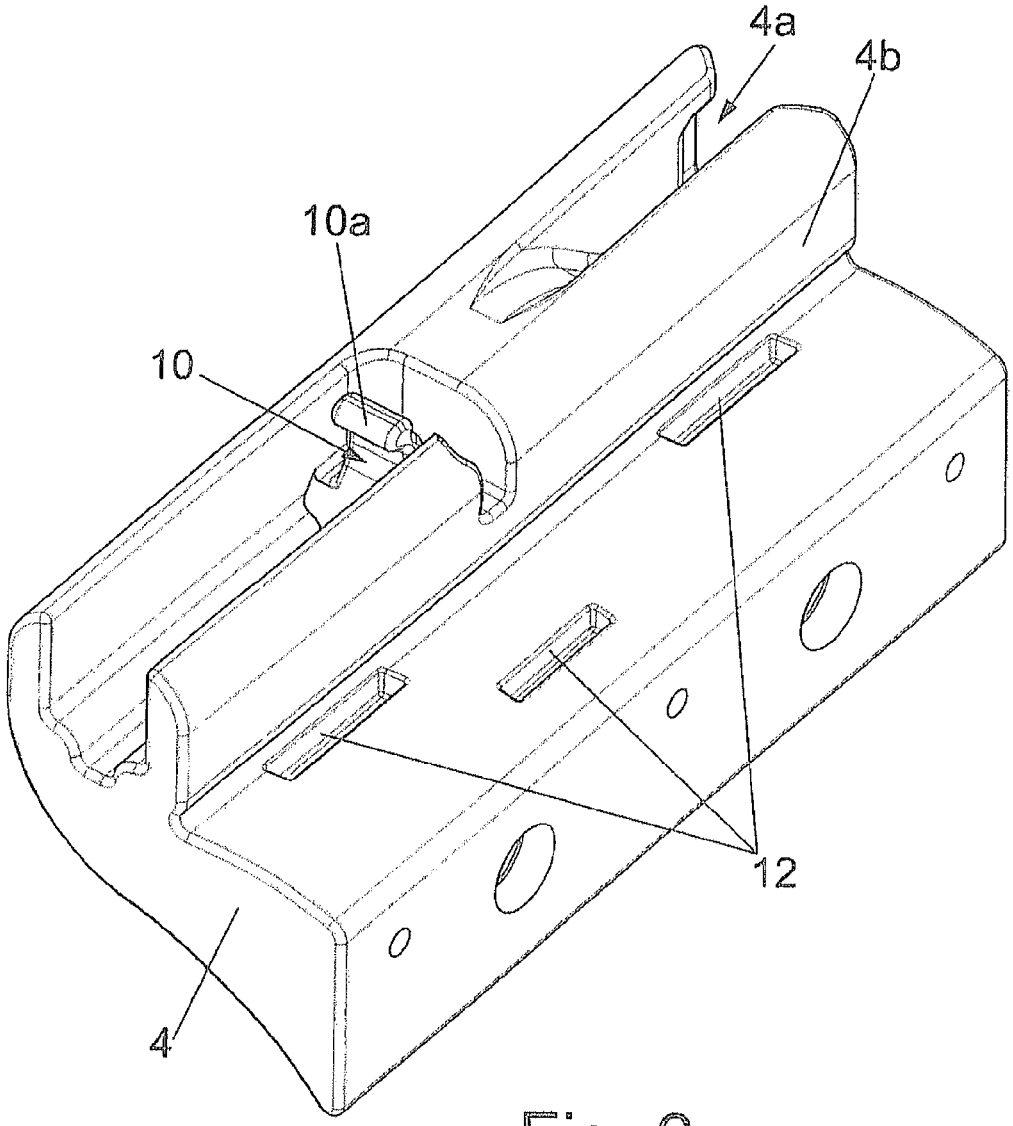
FIG. 6 shows a perspective view of a forward molded part in a viewing direction corresponding to FIGS. 4 and 5
Figure 7:
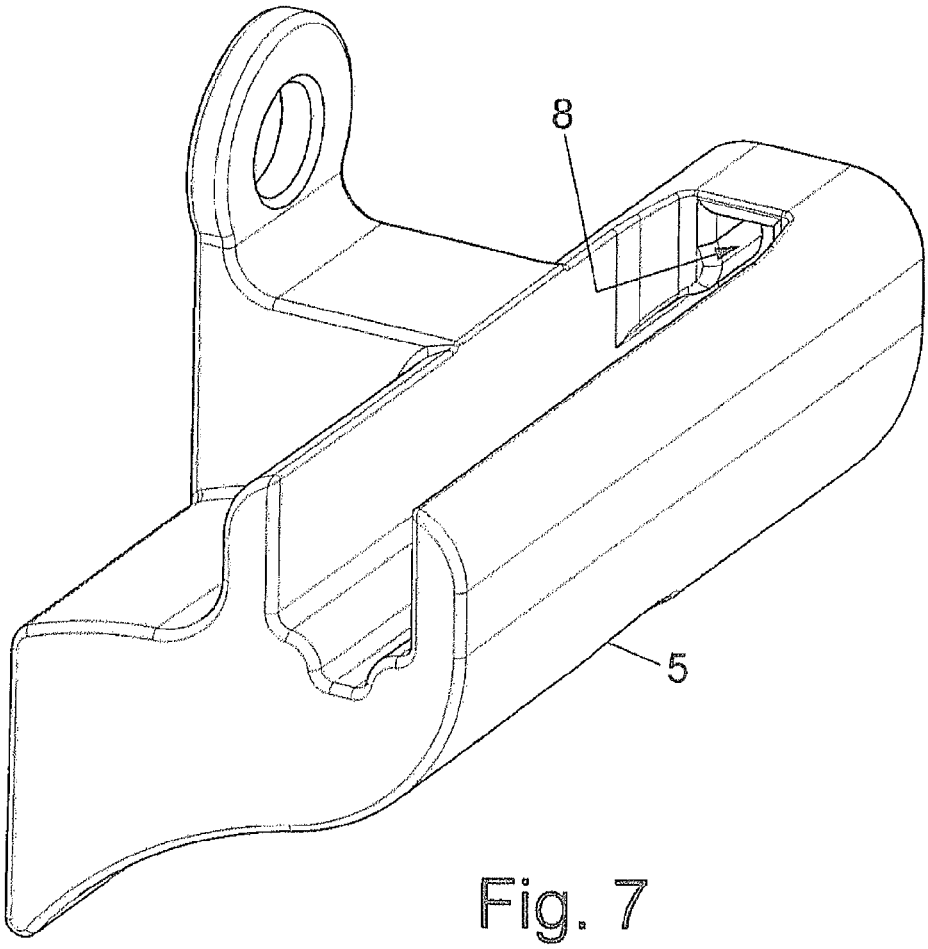
FIG. 7 shows a perspective view of a rear molded part in a viewing direction corresponding to FIGS. 1 and 2
Figure 8:
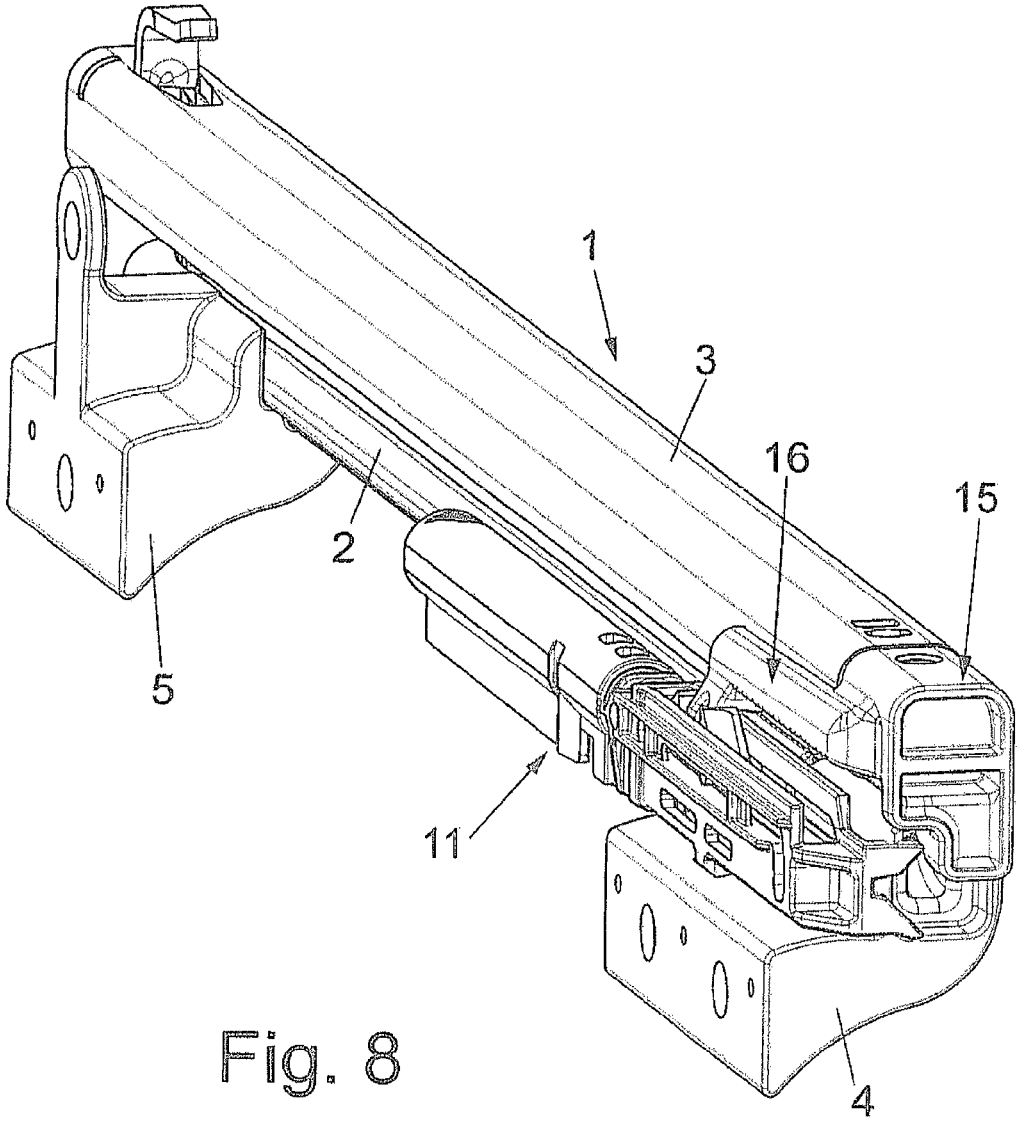
FIG. 8 shows a perspective view of a pullout guide according to a further exemplary embodiment of the invention seen in a viewing direction opposite to FIGS. 1 and 2
Figure 9:
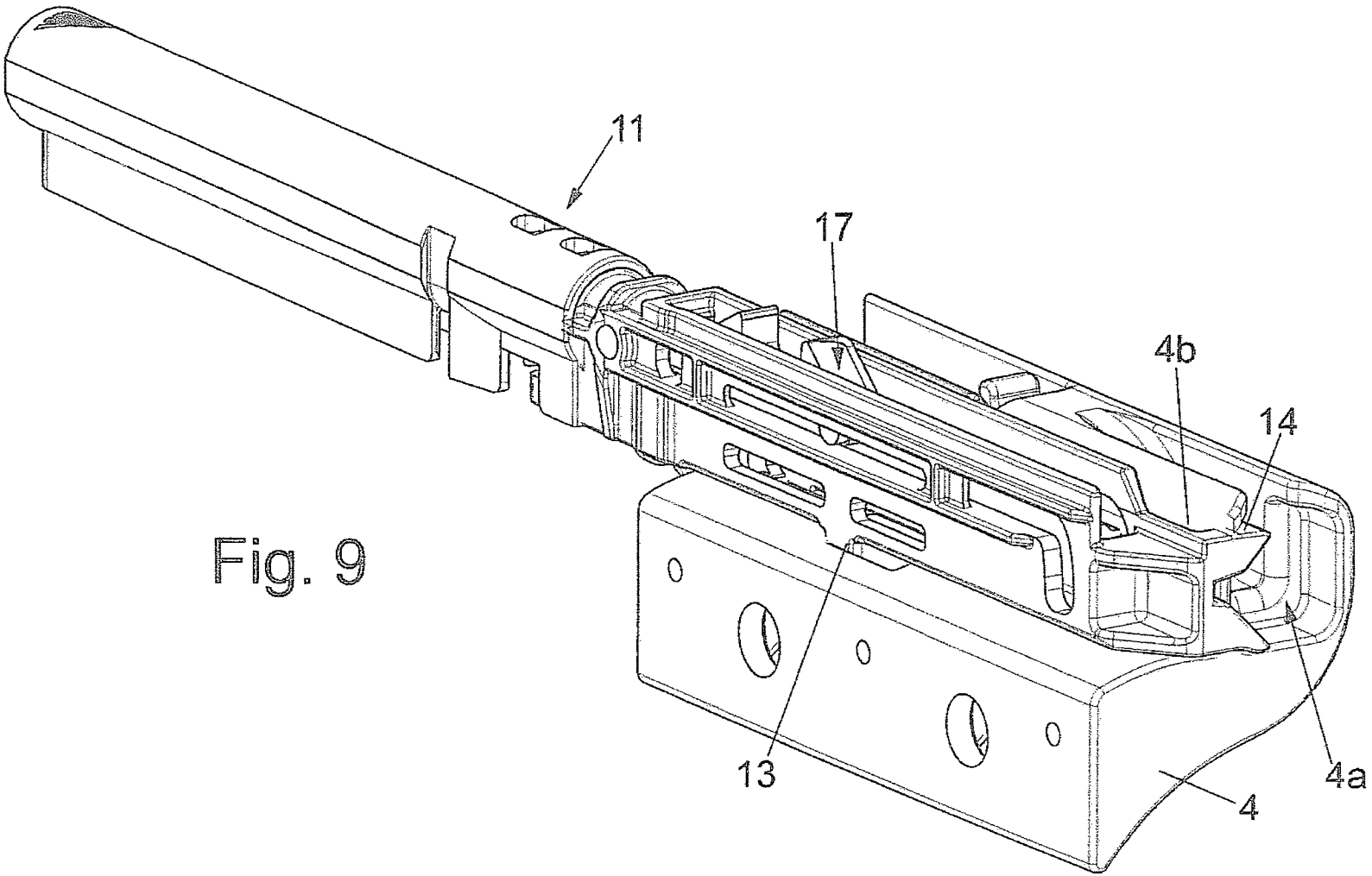
FIG. 9 shows a detail view, enlarged in relation to FIG. 8, of a forward molded part and a self-retractor fixed thereon

FIGS. 8 and 9 show that a pullout guide 1 according to the invention can also be equipped with a self-retractor 11 known per se. The self-retractor 11, as FIG. 8 shows particularly clearly, is fixed on the forward molded part 4 viewed in the insertion direction of the slide rail 3. As is clear from FIG. 6, this forward molded part 4 is provided with multiple passages 12, into which detent webs 13 (see FIG. 9) molded onto the self-retractor 11 are inserted.

In addition, the self-retractor 11 is equipped in its forward end area with holding webs 14, which protrude into the end 4*a* of the molded part 4 open toward the front side and engage behind the wall section 4*b* of the molded part 4 facing toward the self-retractor 11. The self-retractor 11 can thus be fixed on the front molded part 4 without additional connectors in the form of screws or the like.

As is shown particularly clearly in FIG. 8, a closing plug 15 is provided on the forward front end of the slide rail 3, which is equipped with an integrally molded actuator 16 for controlling the self-retractor 11. This actuator 16 engages in a lever 17 of the self-retractor 11 upon tensioning of an arbitrary force accumulator of the self-retractor 11, this lever 17 being able to tilt, from a specific displacement distance, into a position in which the actuator 16 can leave the lever 17. The lever 17 is secured in its position and can first be moved back into its starting position when the actuator 16 comes back into contact with the mentioned lever 17 as the slide rail 3 is inserted, and moves the lever out of its blocking position. At this moment, the force stored in the force accumulator of the self-retractor 11 is used to retract the slide rail 3 and therefore a furniture pullout connected thereto into its final inserted position.

Since the function and mode of operation of a self-retractor 11 and the interaction between a lever 17 of the self-retractor 11 and the actuator 16 are known per se, more detailed description will be dispensed with, since it is only of interest here that the self-retractor 11 is fixed on the front molded part in a simple manner, and an actuator 16 is used which is a component in a way known per se of a plug 15, which terminates the forward front side of the slide rail 3.

The advantage resulting therefrom can be seen in particular in that in this embodiment, the actuator 16 does not have to be welded onto the slide rail 3, which is always problematic if the slide rail 3 is provided with an elevated zinc coating for the purposes of increased corrosion protection.

In contrast, if the above-mentioned considerations do not play a role, of course, a design can also be selected in which an actuator 16 is welded onto the slide rail 3.

In the exemplary embodiments shown, the molded parts 4 and 5 are implemented as separate components and are provided for the purpose of being screwed onto a body of a piece of furniture.

Notwithstanding this, it is also conceivable to design the molded parts 4 and 5 so that they are fixed on a body of a piece of furniture by detent connections, a condition for this possibility, of course, being that the body is provided with corresponding detent openings, detent means, or the like in the connection area.

It is also conceivable to produce the molded parts 4 and 5 integrally with an inner shell of a body of a piece of furniture, which is manufactured from plastic. In particular refrigerators or the like are generally equipped with a corresponding inner plastic shell, so that corresponding molded parts 4 and 5 for mounting and holding the pullout guide 1 may be molded on here.

If the molded parts 4 and 5 are implemented as separate components, they may finally be produced from all expediently usable materials. Depending on the application, plastics, metals, or ceramics come into consideration here.

Metal is preferably used for the pullout guide 1 or its guide rail 2 and its slide rail 3, of course, other materials are also conceivable here, however. For simple application purposes, the guide rail 2 and the slide rail 3 may even be manufactured from plastic.

Figure 12:
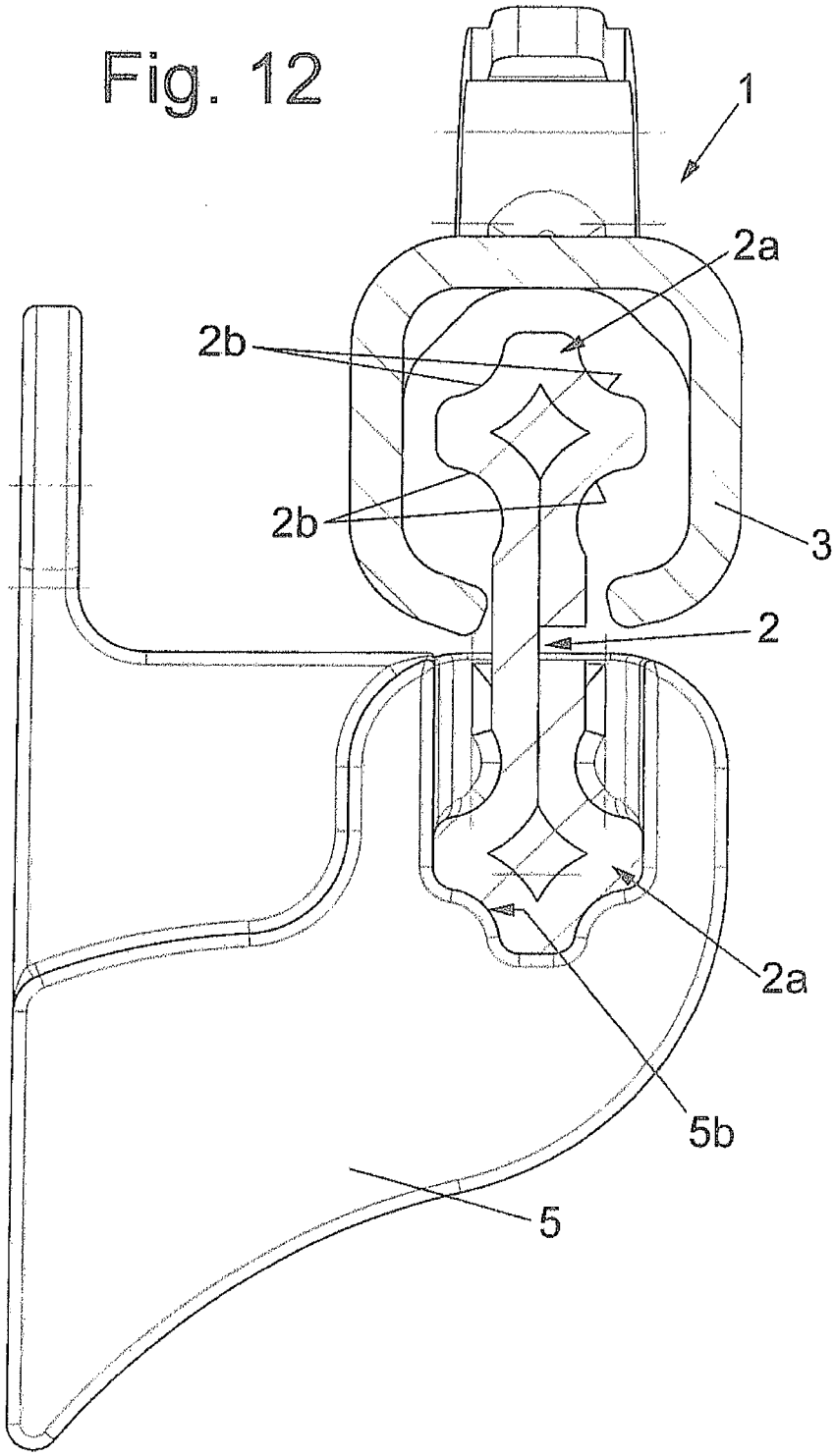
FIG. 12 shows a section along line XII-XII in FIG. 2.

It is disclosed in the sectional view shown in FIG. 12 that the guide rail 2 is a profile which is implemented as mirror-symmetric in cross-section around two axes running perpendicularly to one another. The mentioned axes run vertically and horizontally—in relation to the location of the drawing according to FIG. 12.

In the respective upper and lower end areas, the guide rail 2 is provided with approximately cross-shaped profile areas 2*a*, in which a total of four runways 2*b* for preferably spherical rolling bodies are implemented. The slide rail 3 is guided in relation to the guide rail 2 via these rolling bodies (not shown in FIG. 12).

All runways 2*b* do not have to be occupied with rolling bodies.

In the lower end area, the cross-shaped profile area 2*a* is used to hold the guide rail 2 and a correspondingly profiled channel 5*b* of the rear molded part 5, for example. This also applies accordingly, of course, for the design of the forward molded part 4 in the contact area to the guide rail 2.

As a whole, the guide rail 2 comprises a profile which is used in large quantities in any case by relevant producers of pullout guides, up to this point, however, preferably as a pullout-extending middle rail in so-called full pullouts.

Lubricating greases are necessary for the rolling bodies, if they comprise metal like the rails 2 and 3. Upon use of pullout guides according to the invention in refrigerators, for example, it is accordingly necessary to consider the food compatibility with respect to the lubricating greases.

To meet all requirements here, lubricating greases are to be used which correspond to Guideline 21 CFR 178.3570 of the FDA (US Food and Drug Administration), for example.

In addition, the lubricating greases are to be registered in the category H1 by the NSF (National Sanitation Foundation). Reference is also made in this regard to the new ISO 21469.

In the USA, approval by the USDA (United States Department of Agriculture) according to USDA-H1 may also be necessary. It is to be noted that the guiding regulation for this purpose is to be Guideline 21 CFR 178.3570.

The lubricating greases which are used are additionally to meet the hygiene requirements according to the German version of EN ISO 21469:2006.

The invention claimed is:

1. A pullout guide (1) for furniture pullout parts, comprising a guide rail (2), which is fixable on the body of a piece of furniture, and a slide rail (3), which is connectable to a furniture pullout part, wherein the guide rail (2) has identical cross-shaped profile areas (2*a*) in upper and lower end areas, is mirror-symmetric around two axes running perpendicularly to one another and has multiple runways (2*b*) for rolling bodies, wherein the guide rail (2) is removably fixed terminally in a friction-locked manner on a front load-bearing plastic molded part (4) and a rear load-bearing plastic molded part (5) provided on the body of a piece of furniture, wherein the guide rail (2) has a first notch (6) on a rear end area, which is in the middle of the guide rail (2) and, a projection (7) of an undercut (8) of the rear molded part (5) protrudes into the first notch (6) and overlaps an area (9) of the guide rail (2) lying behind the first notch (6) and thus secures the guide rail (2) against lifting off, wherein the guide rail (2) is provided in a forward end area with a second notch (6) that is identical to the first notch (6) in the rear end area of the guide rail (2), and wherein an area (9) of the guide rail (2) lying below the second notch (6) is engaged behind by a spring element (10) that is integrally molded onto the front molded part (4).

2. The pullout guide according to claim 1, wherein the front molded part (4) and the rear molded part (5) are fixable on a furniture body by screws.

3. The pullout guide according to claim 1, wherein the front molded part (4) and the rear molded part (5) are fixable in a friction-locked manner by detent means or detent recesses of a furniture body.

4. The pullout guide according to claim 1, wherein the front molded part (4) and the rear molded part (5) are integrally produced with an inner shell of a furniture body manufactured from plastic.

5. The pullout guide according to claim 1, wherein a food-compatible lubricating grease is provided for lubricating the rolling bodies and the runways (2*b*).

6. The pullout guide according to claim 1, characterized in that the spring element (10) is additionally provided with a projection (10*a*), which rests in a spring-loaded manner on the area (9) of the guide rail (2) lying below the notch (6).

7. The pullout guide according to claim 6, wherein the guide rail (2) is held without play in the axial direction using the spring element (10).

8. The pullout guide according to claim 1, wherein the pullout guide (1) is equipped with a self-retractor (11).

9. The pullout guide according to claim 8, wherein the self-retractor (11) is fastened in a formfitting manner on the front molded part (4).

10. The pullout guide according to claim 8, wherein an actuator (16), which is fixedly connected to the slide rail (3), is provided for controlling the self-retractor (11).

11. The pullout guide according to claim 10, wherein the actuator is integrally produced with a closure stopper (15), which closes a forward front side of the slide rail (3).

12. A pullout guide (1) for furniture pullout parts, comprising a guide rail (2), which is fixable on the body of a piece of furniture, and a slide rail (3), which is connectable to a furniture pullout part, wherein the guide rail (2) has identical cross-shaped profile areas 12*a*) in upper and lower end areas, is mirror-symmetric around two axes running perpendicularly to one another and has multiple runways (2*b*) for rolling bodies, wherein the guide rail (2) is removably fixed terminally in a form-fitting manner on a front load-bearing molded part (4) and a rear load-bearing molded part (5) that are provided on the body of a piece of furniture, wherein the guide rail (2) has a first notch (6) on a rear end area, which is in the middle of the guide rail (2), wherein a projection (7) of an undercut (8) of the rear molded part (5) protrudes into the first notch (6) and overlaps an area (9) of the guide rail (2) lying behind the first notch (6) and thus secures the guide rail (2) against lifting off, wherein the guide rail (2) has a second notch (6) in a forward end area that is identical to the first notch (6), and wherein a portion of the area (9) of the guide rail (2) lying below the second notch (6) is engaged behind by a spring element (10) that is integrally molded onto the front molded part (4).

* * * * *